United States Patent [19]

Pahade

[11] 4,407,135

[45] Oct. 4, 1983

[54] AIR SEPARATION PROCESS WITH TURBINE EXHAUST DESUPERHEAT

[75] Inventor: Ravindra F. Pahade, North Tonawanda, N.Y.

[73] Assignee: Union Carbide Corporation, Danbury, Conn.

[21] Appl. No.: 328,817

[22] Filed: Dec. 9, 1981

[51] Int. Cl.[3] ..... F25J 3/02

[52] U.S. Cl. ..... 62/13; 62/24; 62/29; 62/31

[58] Field of Search ..... 62/31, 34, 43, 9, 11, 62/23, 24, 29, 32, 33, 36, 38, 39, 42

[56] References Cited

U.S. PATENT DOCUMENTS

| | | | |
|---|---|---|---|
| 3,066,494 | 12/1962 | Potts | 62/31 |
| 3,340,697 | 5/1964 | Cimler et al. | 62/13 |
| 3,754,406 | 3/1971 | Allam | 62/41 |
| 4,099,945 | 7/1978 | Skolaude | 62/30 |

*Primary Examiner*—Frank Sever

*Attorney, Agent, or Firm*—Stanley Ktorides

[57] ABSTRACT

An improved air separation process wherein a stream which is warmed to provide temperature control for a reversing heat exchanger and is expanded to generate plant refrigeration is desuperheated before being introduced to a low pressure distillation column. The process is particularly useful when argon is a desired product of the air separation.

17 Claims, 2 Drawing Figures

AIR SEPARATION PROCESS WITH TURBINE EXHAUST DESUPERHEAT

DESCRIPTION

1. Technical Field

This invention is an improved air separation process which allows one to employ an air fraction for reversing heat exchanger temperature control and for plant refrigeration while avoiding disadvantages heretofore concomitant with such a system.

2. Background Art

Many air separation processes employ reversing heat exchangers to cool and clean the incoming feed air and to warm the product stream or streams to ambient temperature. Incoming air is cooled so that condensibles such as water vapor and carbon dioxide condense onto the heat exchanger. Periodically the flow is reversed and these condensibles are swept out. In order for the unit to be self-cleaning, there is required a means to control the cold end temperature difference between the cooling and warming streams. One way to accomplish this temperature control is to provide a cold end unbalance stream, i.e., a stream which traverses the heat exchanger though only part of its length. The partial traverse of the cooling feed air by the unbalance stream may be accomplished in a number of ways such as having a side header to the heat exchanger or by having two separate heat exchangers.

In many such air separation processes which employ reversing heat exchangers, it is desirable to expand the unbalance stream after it exits the reversing heat exchanger in order to provide refrigeration to the plant. However, the warmed unbalance stream exiting after partial traverse from the reversing heat exchanger, when expanded, has considerable superheat which has a potentially detrimental effect on the efficiency of the air separation process.

A typical air spearation process employs a double column distillation system wherein air is fed to a high pressure column in which the initial separation is carried out and which is in heat exchange relation with a low pressure column, to which air may also be fed and in which the final separation is carried out. Although such double distillation column systems may operate under a great range of pressure conditions depending, for example, on the purity of the products sought, generally the low pressure column operates at a pressure of from 15 to 30 psia and the high pressure column operates at a pressure of from about 90 to 150 psia.

A known method of providing reversing heat exchanger cold end temperature control and plant refrigeration is to employ the high pressure column shelf vapor as the unbalance stream. However, when nitrogen production is desired, such an arrangement has the disadvantage of a reduction in plant operating flexibility because the same shelf vapor flow must be used for three functions—reversing heat exchanger temperature control, plant refrigeration, and product nitrogen production. This latter function imposes a severe separation load on the system because nitrogen must be produced by the high pressure column rather than the low pressure column and, as is well known for distillation systems, increased pressure has an unfavorable influence on the equilibrium between co-existing liquid and vapor fractions requiring additional separation stages, such as trays, for equivalent separation performance. Furthermore, the use of high pressure column shelf vapor for the unbalance stream is disadvantageous if argon recovery is desired because some of the feed bypasses the low pressure column.

To overcome some of these problems, an air fraction has been employed as the unbalance stream. In such a system, the air fraction can be introduced to the low pressure column after it has been turboexpanded. However, because this stream contains considerable superheat, some temperature control of the unbalance stream is required before it is turboexpanded. Typically, this involves exchanging some of the warm unbalance stream flow with some of the cool feed air flow. However, this requires a complex control valve arrangement to maintain required pressure differentials for the desired flow of the mixing streams. Furthermore, this introduces a pressure drop on the entire feed air stream. Still further, the mixing of different temperature process streams represents a thermodynamic energy loss. However, all these disadvantages are considered necessary to obtain the desired result of relatively low superheat in the stream introduced to the low pressure column. As is known, should this stream contain significant heat content, as represented by the superheat, it would adversely affect reflux ratios within the low pressure column and thereby product recovery. Any superheat in the low pressure air stream will vaporize some descending liquid reflux and thereby increase the reflux ratio in the lower section of the low pressure column making the column separation more difficult.

It is, therefore, desirable to provide an air separation process which can employ an air fraction for reversing heat exchanger cold end temperature control and for plant refrigeration while avoiding the difficulties mentioned above.

Accordingly, it is an object of this invention to provide an improved air separation process.

It is another object of this invention to provide an improved air separation process wherein a reversing heat exchanger unbalance stream is desuperheated after expansion for plant refrigeration.

It is a further object of this invention to provide an improved air separation process wherein an air fraction is employed to provide reversing heat exchanger cold end temperature control and plant refrigeration.

DISCLOSURE OF THE INVENTION

The above and other objects which will become apparent to those skilled in the art are achieved by the process of this invention, one embodiment of which comprises:

In a process for the separation of air by rectification wherein feed air at greater than atmospheric pressure is cooled substantially to its dew point and is subjected to rectification in a high pressure column and a low pressure column, and wherein a first stream, having an oxygen concentration of from about 10 percent to that of air, is warmed by partial traverse against said cooling feed air, said first stream then sequentially being expanded and introduced into said low pressure column, the improvement comprising:

(1) withdrawing from said high pressure column a second liquid stream;

(2) cooling said first stream after expansion but before introduction into the low pressure column by indirect heat exchange with said second stream; and (3) returning said second stream to the high pressure column.

Another embodiment of the process of this invention comprises:

In a process for the separation of air by rectification wherein feed air at greater than atmospheric pressure is cooled substantially to its dew point and is subjected to rectification in a high pressure column and a low pressure column, and wherein a first stream having a composition substantially that of air is warmed by partial traverse against said cooling feed air, said first stream then sequentially being expanded and introduced into said low pressure column, the improvement comprising:

(A) dividing the cooled feed air into a major fraction and a minor fraction;

(B) introducing the major fraction into the high pressure column;

(C) dividing the minor fraction into the first stream and a second stream;

(D) cooling the first stream after expansion but before introduction to the low pressure column by indirect heat exchange with said second stream; and (E) introducing the second stream into the high pressure column.

As used herein the term "column" refers to a distillation column, i.e., a contacting column or zone wherein liquid and vapor phases are countercurrently contacted to effect separation of a fluid mixture, as for example, by contacting of the vapor and liquid phases on a series of vertically spaced-apart trays or plates mounted within the column, or alternatively, on packing elements with which the column is filled. For an expanded discussion of distillation columns, see the Chemical Engineers' Handbook, Fifth Edition, edited by R. H. Perry and C. H. Chilton, McGraw-Hill Book Company, New York, Section 13, "Distillation", B. D. Smith et al., page 13-3, *The Continuous Distillation Process.* A common system for separating air employs a higher pressure distillation column having its upper end in heat exchange relation with the lower end of a lower pressure distillation column. Cold compressed air is separated into oxygen-rich and nitrogen-rich fractions in the higher-pressure column and these fractions are transferred to the lower-pressure column for further separation into nitrogen and oxygen-rich fractions. Examples of double-distillation column system appear in Ruheman, "The Separation of Gases," Oxford University Press, 1949.

As used herein the item "superheat" or "superheated vapor" is used to mean a vapor having a temperature higher than its dew point at its particular pressure; the superheat is that heat which constitutes the temperature difference above the dew point.

DETAILED DESCRIPTION

Figure 1:
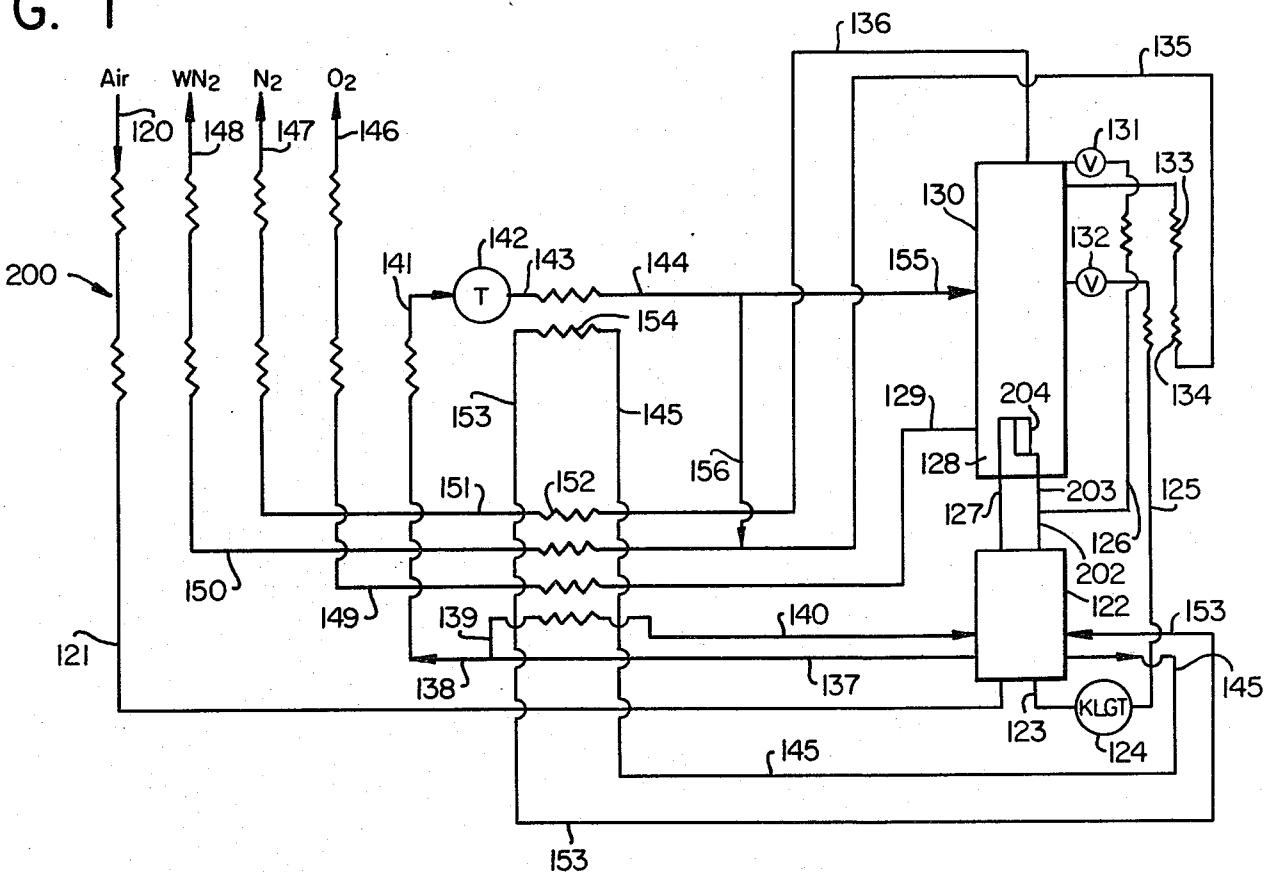
FIG. 1 is a schematic representation of one preferred embodiment of the process of this invention.

The process of this invention will be described in detail with reference to FIG. 1.

Feed air 120 is introduced at about ambient temperature and at greater than atmospheric pressure to reversing heat exchanger 200 where it is cooled and where condensible contaminants such as water vapor and carbon dioxide are removed by being plated on the heat exchanger walls as the air is cooled. The relatively clean and cooled but pressurized air stream 121 is removed from the cold end of the heat exchanger and introduced to the bottom of high pressure column 122. Within this column, the first few stages at the bottom are intended to scrub the rising vapor against descending liquid and thereby clean the incoming vapor feed from any contaminant not removed by the reversing heat exchanger, such as hydrocarbons. After the vapor feed air has been scrubbed of contaminants, a fraction 137 of that stream, having a composition substantially that of air, is removed at a point several trays above the bottom of the high pressure column. A minor portion 139 may be condensed in heat exchanger 152 against return streams 136, 135 or 129 from the low pressure column to warm these streams prior to their introduction to the reversing heat exchanger. The condensed minor portion 140 is then returned to the high pressure column.

The remaining fraction 138 is introduced to the cold end of the reversing heat exchanger and warmed to intermediate temperature 141 so as to control the cold end temperature which is required for self-cleaning of the reversing heat exchanger. This unbalance stream is then removed from the heat exchanger and expanded in turboexpander 142 to develop refrigeration.

The high pressure column 122 separates the feed air into an oxygen-rich liquid 123 and a nitrogen-rich stream 127. The kettle liquid 123 containing any contaminants from the feed air is passed through kettle liquid gel trap 124 which contains suitable adsorbent to remove such contaminant and is passed 125 to the low pressure column 130 after having been previously warmed against waste nitrogen at 134 and expanded to 132.

The nitrogen-rich stream 127 is introduced into the main condenser 204 where it is condensed to provide liquid reflux 203 and where it reboils the bottoms 128 of the low pressure column to provide vapor reflux for this column. Liquid reflux stream 203 is divided into stream 202 which is introduced into the high pressure column and into stream 126 which is warmed against waste nitrogen at 133 and expanded in valve 131 before it is introduced into the low pressure column.

The expanded unbalance stream 143 is desuperheated in heat exchanger 154 by indirect heat exchange with a small stream of liquid 145 withdrawn from the high pressure column at substantially the same point as the vapor air 137. The resulting vapor at 153 is returned to the high pressure column. The desuperheated stream 144 is introduced 155 to the low pressure column. For some applications, such as when argon recovery is desired, a minor fraction 156 of the low pressure desuperheated stream bypasses the low pressure column and is added to the waste nitrogen stream 135. Such arrangement has the advantage of operating heat exchanger 154 in a flooded cooling liquid condition, thereby ensuring maximum possible desuperheating of the turbine exhaust at all times.

It is also possible to use the condensed liquid air stream 140 in exchanger 154 to supply the required coolant for the turbine exhaust desuperheating function. The resulting partly vaporized liquid air stream would then be returned to the high pressure column at substantially the same point.

The vapor stream 137 preferably has the same composition as air. Typically, this stream may have an oxygen composition of about 19 to 21 percent oxygen. For some applications, the vapor stream 137 can be withdrawn from a higher point in column 122 and thereby have an oxygen content as low as about 10 percent oxygen; still lower oxygen contents would undesirably shift too much of the separation to the high pressure column. The volumetric flow rate of the stream employed for cold end temperature control is preferably from 7 to 18 percent, most preferably from 9 to 12 percent of the feed air flow rate.

The liquid stream 145 is preferably withdrawn from the column 122 at essentially the same point as the vapor stream 137, just above the scrubbing section of column 122. This means that the liquid stream will typically be close to equilibrium with that rising vapor. This is the case since the lower scrubbing section of column 122 is primarily intended to wash the rising vapor with the descending liquid and not to perform substantial separation. The composition of the liquid will depend on the distillation column 122 process conditions, including the pressure and number of separation stages or trays, but preferably will range from about 35 to 39 percent oxygen. However, this liquid can have an oxygen content of from about 30 to 45 percent depending on the process conditions. Another suitable coolant liquid source for stream 145 would be downstream of the kettle liquid gel trap 124, as for example, stream 125. This liquid would be cleaned of any contaminants by the trap and would have a composition comparable to that just above the scrubbing section within the column.

The return streams to the high pressure column 122 are preferably introduced to the column at the same level as the withdrawal streams. That is, streams 140 and 153 are preferably returned at the same column level, respectively, as stream 137 and stream 145 are withdrawn. This is generally preferable, since the fluid flows can be handled more easily. However, the same level return criteria is not critical to the improved process of this invention, and since these return streams are relatively minor flow streams having a maximum of only several percent of the feed air, introduction of the streams at any suitable point to the column 122 is satisfactory.

The low pressure column 130 performs the final separation and produces a product oxygen stream 129 and a waste nitrogen stream 135 which can be used to subcool the liquid reflux in heat exchangers 133 and 134. Additionally, the low pressure column can be used to produce nitrogen product 136 from the top of that column. All of these return streams may be superheated in heat exchanger 152 against the small condensing air stream 139 before they enter the reversing heat exchanger 200 as product oxygen 149, waste nitrogen 150 and product nitrogen 151 and from which they exit as 146, 148 and 147 respectively.

When the incoming feed air, after passage through the reversing heat exchanger to clean out the condensible contaminants, is further cleaned of other contaminants upon exiting from the reversing heat exchanger by passage through filter means such as a cold-end gel trap, a fraction of the resulting cleaned feed air may be used directly for reversing heat exchanger cold-end temperature control and for plant refrigeration without requiring that all of the feed air be passed to the high pressure column to accomplish the further cleaning. One embodiment of such an arrangement employing a cold-end gel trap is shown in FIG. 2. The numerals of FIG. 2 correspond to those of FIG. 1 for those process features which are common to both. The discussion of the embodiment shown in FIG. 2 will describe in detail only those portions of this embodiment which differ materially from the embodiment shown in FIG. 1.

In the embodiment shown in FIG. 2, feed air 120 is introduced at about ambient temperature and at greater than atmospheric pressure to reversing heat exchanger 200 and, upon exiting from the heat exchanger, is passed through cold-end gel trap 196 to further clean the air of contaminants such as hydrocarbons. The cooled and cleaned air stream 121 is then divided into a major portion 171 and a minor portion 172. The major portion 171 is introduced to the high pressure column 122 as feed while the minor portion is divided into stream 173, which is introduced to the reversing heat exchanger for cold end temperature control, and into stream 174. Stream 173 is removed from the reversing heat exchanger after partial traverse at 141, expanded in turboexpander 142 and the expanded stream 143 is desuperheated by indirect heat exchange with stream 174. This embodiment additionally illustrates the option of employing stream 174 to heat the return process streams from the low pressure column at heat exchanger 152. Also illustrated is the optional bypass 156 discussed previously.

The expanded and desuperheated stream 144 is introduced 155 to the low pressure column 130 and stream 174 is introduced to the high pressure column.

In this embodiment, the minor fraction 172 preferably contains from 7 to 18 percent, most preferably from 9 to 12 percent, of the incoming feed air on a volumetric flow rate basis, with the remainder of the feed air being in the major fraction 171. Stream 174 preferably contains from 1 to 3 percent, most preferably about 2 percent, of the incoming feed air on a volumetric flow rate basis. Stream 173 comprises the minor fraction 172 less that portion which is divided out to become stream 174.

Figure 2:
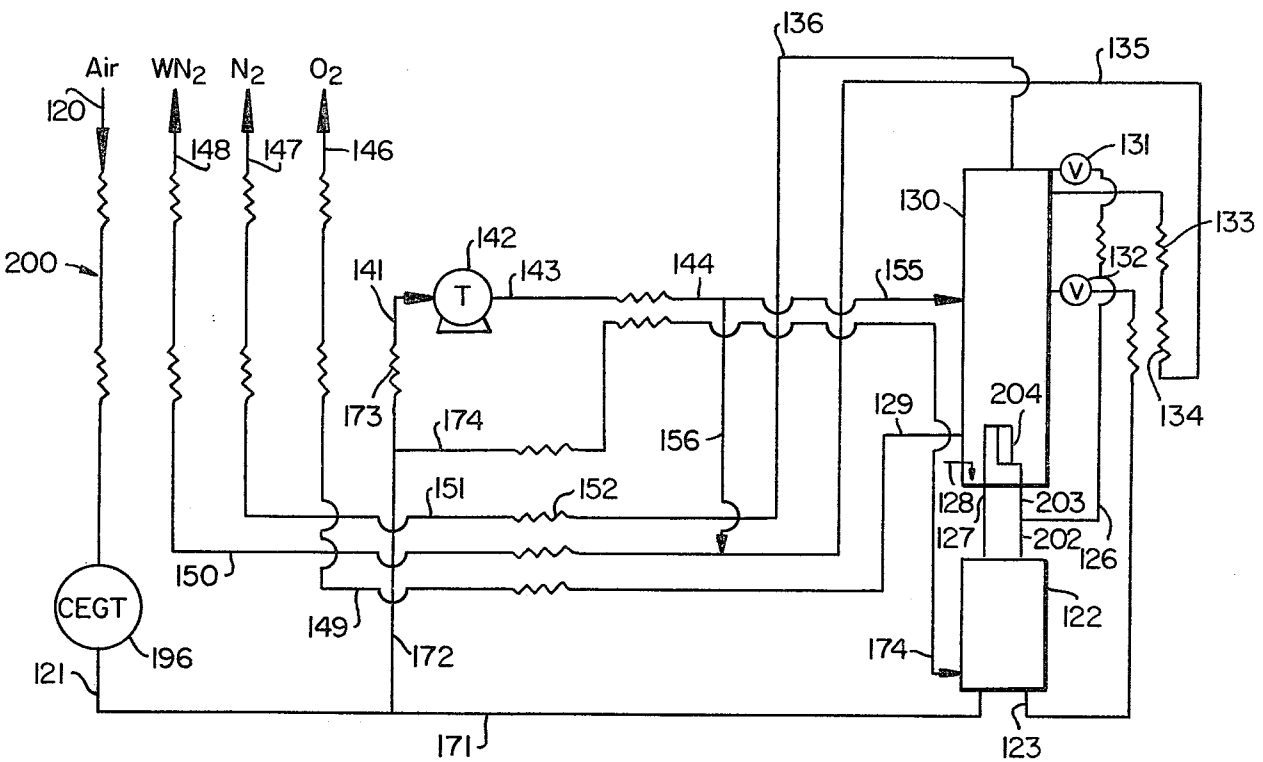
FIG. 2 is a schematic representation of another embodiment of the process of this invention.

When the cold-end gel trap arrangement is employed, it may be more preferable to desuperheat the expanded unbalance stream by indirect heat exchange with a stream taken from the high pressure column, such as stream 145 of the FIG. 1 embodiment, rather then with a stream split off from the cleaned feed air, such as stream 174 of the FIG. 2 embodiment. The determination of which arrangement would be the more preferable will depend on factors such as heat transfer efficiency, construction and piping ease, and on other factors known to those skilled in the art.

The process of this invention allows the turbine exhaust stream to be cooled close to the air saturation conditions corresponding to the high pressure column. Typically, high pressure column air saturation temperature will range from about 95° to 105° K. Cooling the turbine air exhaust to the high pressure column air saturation temperature results in removal of significant superheat from the turbine exhaust, generally ranging from at least about 10° K. to as much as about 30° K. This is generally from about 20 percent to about 80 percent of the superheat in the turbine exhaust. The amount of reduced superheat is very significant relative to any remaining superheat and has a significant impact on low pressure column performance.

The cold end temperature control stream which makes a partial traverse of the reversing heat exchanger may be removed from the reversing heat exchanger at any point; this will be dependent in part on process variables. However, it is preferred that this stream be removed from the reversing heat exchanger at about the midpoint of the heat exchanger. The temperature of the temperature control stream, upon removal from the reversing heat exchanger, is typically from about 150° to 200° K.

The process of this invention is particularly advantageous when argon production is desired. As is know when argon production is desired, a stream from the low pressure column may be fed to an argon column to be separated into argon-richer and argon-poorer fractions. The argon-richer fraction may be fed to an argon refinery and the argon-poorer fraction returned to the low pressure column.

As can be appreciated, all of the above described embodiments of the process of this invention employ desuperheating of the turbine exhaust prior to its introduction into the low pressure column. Those skilled in the art may devise process arrangements other than those specifically discussed and illustrated which are not inconsistent with the essential elements of the improved process of this invention.

A typical practice of the process of this invention is illustrated by the process conditions, shown in Table I, obtained from a computer simulation of mass and heat balances associated with an oxygen plant which also produces nitrogen and argon. Feed air is processed to produce corresponding oxygen, nitrogen, and argon products utilizing the process of this invention as illustrated in FIG. 1. The stream numbers correspond to those in FIG. 1. As can be seen from the tabulation, the air stream withdrawn from the high pressure column and utilized for unbalance of the reversing heat exchangers is about 11 percent of the feed air and is removed from the heat exchanger unit at about 184° K. and 93 psia. This stream is then turboexpanded directly to produce plant refrigeration to an exhaust pressure of about 21 psia and corresponding exhaust temperature of about 129° K. This condition represents substantial superheat in the exhaust gas which would be a significant disadvantage if this stream were directly introduced into the low pressure column. Instead, this stream is cooled to about 103° K. which is close to the saturation temperature of the high pressure column air at the corresponding pressure condition (about 101° K. at 93 psia) and then introduced into the low pressure column. The air desuperheating is performed by indirect heat exchange with a liquid obtained from the high pressure column. The process arrangement serves to reduce the turbine exhaust superheat by about 26° K. of the maximum available 44° K. This reduction of turbine air superheat has a significant effect on the performance of the low pressure column separation. Although the tabulation illustrates specifically a turbine inlet temperature of about 184° K. and corresponding outlet temperature of about 129° K. and subsequent cooling of about 26° K., it is understood that the practice of this invention encompasses a range of such conditions.

TABLE I

| | |
|---|---|
| Products (cfh) | |
| Oxygen | 1,514,000 |
| Nitrogen | 1,514,000 |
| Crude Argon | 60,000 |
| Air Feed Flow (cfh) | 7,405,000 |
| Air RHX unbalance | |
| Stream 138 (cfh) | 800,000 |
| (% Feed Air) | 10.8 |
| Turbine Air Fraction | |
| Flow (Stream 141 (cfh) | 800,000 |
| (% Feed Air) | 10.8 |
| Inlet Temperature °K. | 184 |
| Inlet Pressure, psia | 93 |
| Exhaust Temperature °K. | 129 |
| Exhaust Pressure, psia | 21 |
| Low Pressure Air to Column | |

TABLE I-continued

| | |
|---|---|
| Flow (Stream 155) (cfh) | 625.000 |
| (% Feed Air) | 8.4 |
| Temperature °K. | 103 |

I claim:

1. In a process for the separation of air by rectification wherein feed air at greater than atmospheric pressure is cooled substantially to its dew point and is subjected to rectification in a high pressure column and a low pressure column, and wherein a first stream, having an oxygen concentration of from about 10 percent to that of air, is warmed by partial traverse against said cooling feed air, said first stream then sequentially being expanded and introduced into said low pressure column, the improvement comprising:
   (1) withdrawing from said high pressure column a second liquid stream;
   (2) cooling said first stream after expansion but before introduction into the low pressure column by indirect heat exchange with said second stream; and
   (3) returning said second stream to the high pressure column.

2. The process of claim 1 wherein said first stream is a vapor stream withdrawn from the high pressure column.

3. The process of claim 1 wherein said first stream is a fraction of cooled feed air which has been passed through filter means for removal of contaminants.

4. The process of claim 1 wherein said second stream is returned to the high pressure column completely as vapor.

5. The process of claim 1 wherein said first stream has an oxygen concentration of from 19 to 21 percent.

6. The process of claim 1 wherein said second stream has an oxygen concentration of from 30 to 45 percent.

7. The process of claim 1 wherein said second stream has an oxygen concentration of from 35 to 39 percent.

8. The process of claim 1 wherein the temperature of said first stream after warming but before expansion is from 150° K. to 200° K.

9. The process of claim 1 wherein the volumetric flow rate of said first stream is from 7 to 18 percent of the feed air flow rate.

10. The process of claim 1 wherein the volumetric flow rate of said first stream is from 9 to 12 percent of the feed air flow rate.

11. The process of claim 1 wherein said cooling step (2) removes from about 20 percent to about 80 percent of the superheat from the expanded first stream.

12. In a process for the separation of air by rectification wherein feed air at greater than atmospheric pressure is cooled substantially to its dew point and is subjected to rectification in a high pressure column and a low pressure column, and wherein a first stream having a composition substantially that of air is warmed by partial traverse against said cooling feed air, said first stream then sequentially being expanded and introduced into said low pressure column, the improvement comprising:
   (A) dividing the cooled feed air into a major fraction and a minor fraction;
   (B) introducing the major fraction into the high pressure column;
   (C) dividing the minor fraction into the first stream and a second stream;

(D) cooling the first stream after expansion but before introduction to the low pressure column by indirect heat exchange with said second stream; and (E) introducing the second stream into the high pressure column.

13. The process of claim 12 wherein the temperature of said first stream after warming but before expansion is from 150° K. to 200° K.

14. The process of claim 12 wherein the volumetric flow rate of said minor fraction is from 7 to 18 percent of the feed air rate.

15. The process of claim 12 wherein the volumetric flow rate of said minor fraction is from 9 to 12 percent of the feed air rate.

16. The process of claim 12 wherein the volumetric flow rate of said second stream is from 1 to 3 percent of the feed air rate.

17. The process of claim 12 wherein said cooling step (D) removes from about 20 percent to about 80 percent of the superheat from the expanded first stream.

* * * * *